United States Patent [19]

Bonds

[11] 4,093,030

[45] June 6, 1978

[54] RUN-IN AND TIE BACK APPARATUS

[75] Inventor: James Vaull Bonds, Houston, Tex.

[73] Assignee: McEvoy Oilfield Equipment Company, Houston, Tex.

[21] Appl. No.: 762,181

[22] Filed: Jan. 24, 1977

Related U.S. Application Data

[60] Division of Ser. No. 543,123, Jan. 22, 1975, Pat. No. 4,646,405, which is a continuation of Ser. No. 253,516, May 15, 1972, abandoned.

[51] Int. Cl.[2] ..... E21B 23/00; E21B 43/10

[52] U.S. Cl. ..... 166/315; 166/208

[58] Field of Search ..... 166/315, 85, 0.6, 88, 166/89, 208; 285/3, 18, 140–143

[56] References Cited

U.S. PATENT DOCUMENTS

| | | | |
|---|---|---|---|
| 3,404,736 | 10/1968 | Nelson et al. | 285/142 |
| 3,457,992 | 7/1969 | Brown | 166/0.6 |
| 3,461,958 | 8/1969 | Brown | 166/315 |
| 3,540,533 | 11/1970 | Morrill | 166/315 |

OTHER PUBLICATIONS

OBS-C Wellhead System, Oil Center Tool, pp. 3540, 3541. Publication cited by applicant, assumed prior art, Jan. 24, 1977.

*Primary Examiner*—James A. Leppink

*Attorney, Agent, or Firm*—David M. Ostfeld; Murray Robinson; Ned L. Conley

[57] ABSTRACT

The described invention includes method and apparatus for the installation of a casing hanger supporting a string of casing down hole in an oil or gas well, for removal of the installation equipment, and for tying back the hanger to an insulated production riser extending to the surface. The casing hanger is lowered into the well on drilling casing, having a smaller outside diameter than the insulated production riser casing, to permit a sufficiently large annulus for the passage of fluid between the drilling riser and the previously installed drilling riser. The drilling riser is removed by disconnecting it from the hanger by clockwise rotation of the drilling riser. The insulated production riser casing, or other special riser pipe, having a larger outside diameter than the drilling riser casing, is used to tie back with the hanger where standard riser casing is not suitable for the production of oil or gas, e.g. in the case of production through permafrost, by a clockwise rotation of the drilling riser. Clockwise rotation is used both to disconnect the drilling riser and to connect the production riser. To perform these operations three preferred embodiments of the invention are described: one having two threaded connections, a second having a threaded connection and a latching mechanism, and a third having a latching mechanism for both operations. All threaded connections and latching mechanisms include an axially sliding nut.

6 Claims, 20 Drawing Figures

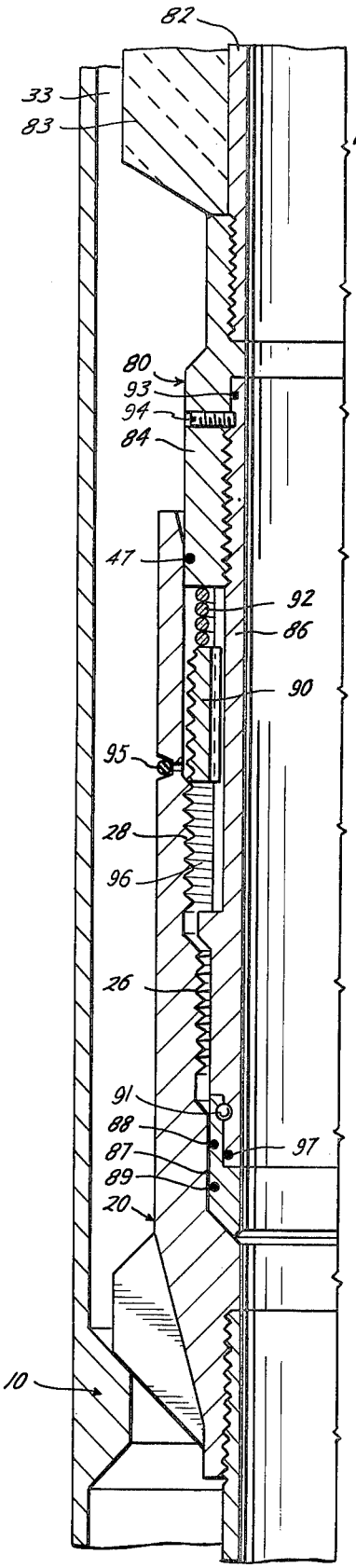
Fig. 5
Fig. 6
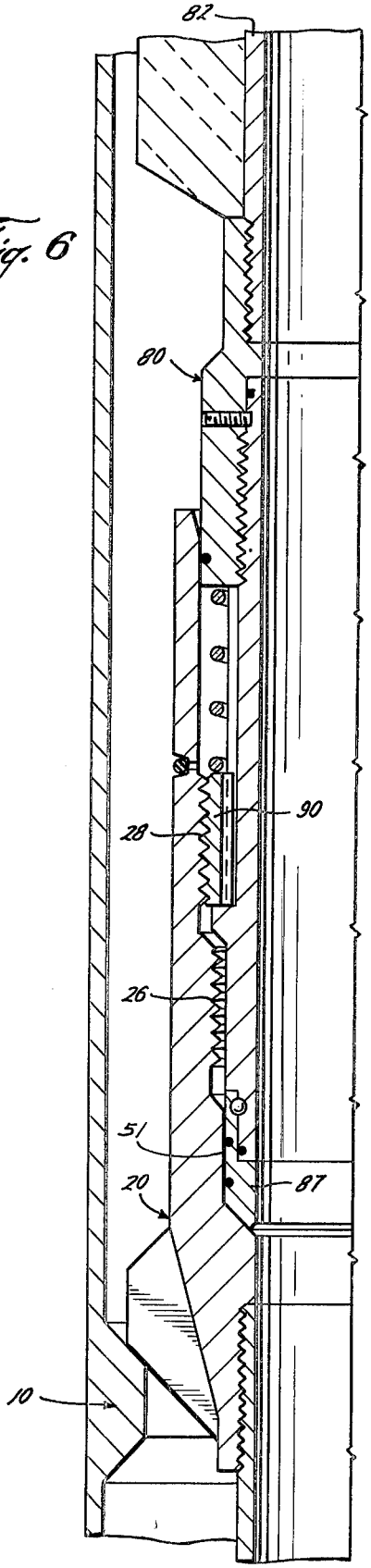

RUN-IN AND TIE BACK APPARATUS

This is a division of application Ser. No. 543,123, filed Jan. 22, 1975, now U.S. Pat. No. 4,646,405 which is a continuation of parent application Ser. No. 253,516, filed May 15, 1972 now abandoned.

BACKGROUND OF THE INVENTION

1. Field of the Invention

This invention pertains to the completion of oil and gas wells, and more particularly, to a method and apparatus for running a string of casing and casing hanger into the well, removal of the handling string and run-in tool, and tying back the casing hanger with the surface by means of a tie back tool and insulated riser casing. The apparatus includes a particular casing hanger adapted for cooperation with special run-in and tie back tools. The invention is particularly directed to running in a string of casing with a handling string, cementing the casing by circulating fluid through the handling string and back up around the annulus, removing the handling string, and tying back into the casing hanger with an insulated riser for completing a well through permafrost.

2. Description of the Prior Art

In the completion of oil and gas wells, often it becomes desirable to suspend a string of casing from a location within the well which is not only below but spaced from the level of the Christmas tree. This may occur, for example, where the well is under water or extends through permafrost. Initially, in the drilling of such a well an outer conductor casing is installed in the ground with a well head at or below the level of the bottom of the water or permafrost and a conductor riser extending to the top of the water or permafrost. Then a varying number of strings of casing and tubing are suspended within the conductor casing. Each of these latter strings of pipe is attached to a hanger which is supported by a head affixed to the previously installed casing. When the casing is to be suspended a hanger is attached to the upper end of the string and the hanger is attached to a handling tool. The handling tool is affixed to a handling string, generally made up of drilling casing, which is used to run the hanger into the well through the conductor riser to the level of the well head in which the hanger is to be suspended. The handling tool may later be disconnected from the hanger and the tool and handling string removed from the well. To one of the casing hangers may then be connected a drilling riser extending up to the top of the water or permafrost where the Christmas tree is to be installed. This is achieved by affixing a tie back extension tool to the drilling riser and running the assembly into the well for tying back with the casing hanger.

Although there are various reasons and occasions for suspending casing within the well, a level spaced below the Christmas tree, the two most common occur while drilling offshore or while drilling in a permafrost region. Permafrost is permanently frozen mud which is found, for example, on the north slope of Alaska. Although the present invention is applicable to any situation requiring the suspension of casing in remote location, the present invention was primarily designed for problems occurring in a well drilled through permafrost. In a permafrost region the casing must be suspended in solid ground or rock below the interface (permafrost line) of the permafrost and solid ground because of the possible subsidence characteristics of the permafrost.

The present invention concerns the problem of the heat given off by the oil as it is produced from a well which has been drilled through permafrost. As the oil rises it will give off heat which will melt the permafrost if standard casing has been used. This turns the permafrost into mud around the outside of the conductor casing causing subsidence which is undesirable. Such subsidence causes the ground supporting the base of the drilling and production platform to shift and sink. Therefore, insulation is used to insulate the permafrost from the heat given off by the oil. This insulation is generally achieved by using an insulated production casing which extends from the hanger to the surface thereby insulating the oil as it flows through the region surrounded by permafrost.

Problems are created in the completion of such a well since insulated production casing cannot be used to lower the hanger into the well. Standard riser casing must be used since it has a smaller outside diameter. The smaller diameter is required because upon the installation of the hanger the seals are tested and the production tubing is perforated for the production of oil or gas. If insulated riser casing were used to lower the hanger, the added diameter of the riser casing would prevent the seal tests and perforation since the circulation of any drilling fluid through the annulus between the insulated riser casing and the conductor casing would be inhibited. Also, the casing string is cemented after the hanger has been installed thereby requiring the flow of cement down through the handling string and requiring the returns from the cement to pass through the annulus. Standard drilling riser casing also permits a greater degree of control during this portion of the completion of the well. Standard drilling riser casing cannot be used during the production of the well due to its being uninsulated. Therefore, because of these difficulties, the hanger is lowered using standard drilling riser casing and then later replaced with insulated production riser casing prior to production. The drilling riser is generally replaced with a new production riser anyway because the drilling riser often becomes worn and damaged during the drilling operation thereby not being capable of withstanding the greater pressures in the well during the production operation.

Completions of wells drilled through permafrost are few in number and, therefore, little prior art is available on apparatus which may have been used to overcome these difficulties. Presently, it is presumed that the casing hanger is merely lowered by means of a conventional threaded connection between the handling tool and casing hanger, and the tie-back is later achieved in the same manner by using a conventional threaded connection between the tie-back extension tool and the same threaded portion of the casing hanger as was used for the run-in tool.

Problems arise in using a conventional threaded connection because the connections between the drilling casing making up the handling string are of the same hand as the connection between the handling tool and casing hanger. Therefore, when the handling string is rotated to disconnect the handling tool from the hanger, the connections between the sections of pipe making up the handling string also unthread. These problems have been solved in connection with noninsulated risers used as the production casing string by using left hand threaded connections between the risers and hangers.

These are called back off joints. Such joints are suitable, where the handling string on which the casing is run is suitable for use as a riser and need not be removed unless the well is to be abandoned, or where the particular casing is not needed for production and need not be replaced after removal. The present invention solves the problem occurring when it is necessary to tie in with insulated riser casing after removal of the handling string. Examples of the use of left hand thread back off joints are to be found in U.S. patent application Ser. Nos. 103,839 and 76,664.

Several other problems occurred when operating off of two threads. The casing would get stuck in the connection and it could not be either tightened or loosened from the connection. This would cause galling of the threads, upon tying back with insulated riser casing, a seal could not be re-established in the connection and often so much torque was lost that there would not be sufficient torque at the wellhead to make the connection.

The use of the conventional threaded connection between the casing hanger and the tie-back extension tool also causes extreme wear on the seals which have been compressed between the inner surface of the casing hanger and the outer surface of the tie-back extension tool. The tie-back extension tool is necessarily rotated to complete the threaded connection with the casing hanger and this causes frictional wear on the seals as they rub between the two surfaces.

The problem of frictional wear on the seal due to rotation with a threaded connection has previously been attacked in connection with casing suspension apparatus as shown by U.S. Pat. No. 3,588,130-Fowler. See also U.S. Pat. No. 3,540,533-Morrill. The use of a rotatable connection between two well pipe elements is also shown in U.S. patent application Ser. No. 87,783. A running tool for well casing is disclosed in U.S. Pat. No. 3,489,436 (issued Jan. 13, 1971 on the application of A. G. Ahlstone).

Overcoming the problem of making and breaking connection with a remotely located well element has been the object of a number of patents, e.g. U.S. Pat. No. 3,330,341 Jackson and Rhodes.

SUMMARY OF THE INVENTION

The present invention not only eliminates the problem of the tendency of the handling string to disconnect at its joints, but it also prevents any wear on the seals during the installation of the drilling riser. All of the embodiments of the present invention utilize a rotation which causes the coupling connections in the handling string, whether it be drilling casing or production casing, to thread into a tighter connection rather than disconnect. In other words, to activate the mechanism to disconnect or connect the handling string to the casing hanger, the present invention uses a rotation causing the threads of the handling string couplings to engage rather than disengage. The connection mechanism used in the present invention is either a retractable latching ring or a splined nut, i.e. an externally threaded ring internally splined to a tubular mandrel. No wear is caused on the seals since the seals are never required to rotate with the handling tool once they are sealingly engaged.

In embodiment I a running tool, having a pack-off assembly rotatably mounted on its lower end and an externally threaded nut splined to the outer surface of the tool to permit axial motion, is stabbed into the casing hanger. The running tool is rotated counterclockwise thereby connecting the splined nut to the lefthand threads on the internal surface of the hanger by a downward motion of the nut. The assembly is run into the well until flutes on the hanger engage the casing head affixed to the previously installed casing. The weight of the drill pipe, having right hand engageable couplings, compresses the pack-off assembly thereby forcing the seal to sealingly engage the internal surface of the casing hanger. The casing suspended by the hanger is then cemented into place.

To remove the drilling riser and running tool, the drilling riser is rotated clockwise tightening the right hand engageable couplings and causing the splined nut to ascend due to its rotation on the lefthand threads of the casing hanger. When the splined nut disengages from the lefthand threads of the casing hanger, the running tool and drilling riser can then be removed from the well. Because of the rotary connection, the pack-off assembly remains stationary while the handling tool rotates thus preventing any wear on the pack-off seal.

To tie back with the hanger, a tie-back extension tool is affixed to the lower end of insulated riser pipe. Similarly, as with the running tool, a pack-off assembly is rotatably attached to the lower end of the tie-back extension tool, and a nut is splined to the outer surface of the tie-back extension tool thereby permitting axial movement. The splined nut attached to the outer surface of the tie-back extension tool has a larger outside diameter than the previously described splined nut used on the running tool. This is required since to connect the tie-back extension tool with the casing hanger, the splined nut must descend rather than ascend. To reverse the movement of the splined nut a second set of internal threads have been placed in the upper portion of the casing hanger which have righthand threads rather than lefthand threads. Therefore, the second set of internal threads permit the splined nut to engage righthand threads and move downwardly rather than upwardly as before.

The tie-back extension tool is connected to the insulated production riser casing, and the assembly is lowered into the hole and stabbed into the casing hanger. The production riser is then rotated to the right causing the splined nut to engage the righthand threads of the casing hanger and move downwardly to complete the connection. The weight of the production riser compresses the pack-off assembly to sealingly engage the internal surface of the hanger.

The production riser can be removed by the counterclockwise rotation of the production riser thereby disconnecting the tie-back extension tool from the casing hanger.

In the second preferred embodiment a threaded connection is again used to disconnect the handling tool and casing hanger upon the clockwise rotation of the handling string, but the tie-back extension tool is connected to the casing hanger through the use of a latching mechanism actuated by the clockwise rotation of the production riser rather than a threaded connection as in embodiment I. The running tool used in embodiment II is comparable to that used in embodiment I. The method in embodiment II for lowering the assembly into the well and for disconnecting the running tool from the hanger is the same as that previously described in embodiment I and therefore will not be discussed further.

To tie back the production riser to the casing hanger the tie-back extension tool is attached to the insulated production riser casing, and the assembly is lowered into the well with the tie-back extension tool being stabbed into the casing hanger. The righthand rotation of the tie-back extension tool causes a nut, threaded to the outer surface of the tool, to rise thereby forcing a normally contracted snap ring to be cammed onto a support and to expand into an internal recess in the casing hanger.

To remove the tie-back extension tool and production riser, a special releasing tool is lowered into the well engaging a reciprocable sleeve on the inner surface of the tie-back extension tool. By forcing down on the sleeve through the use of the special releasing tool, a shear pin is broken thereby permitting the release of the cam support holding the snap ring into engagement with the internal recess of the casing hanger. The support is then removed by lifting the production riser which pulls the support out from beneath the snap ring and allows it to retract from within the recess. The assembly can then be removed from the well.

Embodiment II has an advantage over embodiment I in that the tie-back extension tool may be removed from the well without a counterclockwise rotation of the production riser which causes the connections between the sections of pipe making up the riser handling string to loosen. Embodiment II, however, does require the use of a third running tool to remove the riser.

The third embodiment has one latch mechanism and has no threaded connections as described in embodiments I and II. The third embodiment utilizes one combined tool, not only to run the casing hanger into the well, but also to tie-back with the production riser.

The combined tool of the third embodiment has two clutched nuts circumscribing the outer surface of the running tool. The upper nut has a clutch engagement with the upper portion of the combined tool and the lower nut has a clutch type engagement with a ring splined to the lower portion of the combined tool. The latching mechanism operates such that upon the threaded engagement of the two splined nuts, a normally retracted snap ring latch is expanded into a recess in the internal surface of the casing hanger by means of a cam much like that of embodiment II, and if the nuts are unthreaded the support holding the latch in its expanded position is removed such that it frees the combined tool from the casing hanger.

To secure the tool to the casing hanger, the combined tool is rotated clockwise, thereby forcing the upper clutch nut to rotate with the tool and causing the lower unengaged clutch nut to rise thereby expanding the snap ring latch into the recess of the casing hanger.

Then to sealingly engage the casing hanger, the drilling riser is put into tension thereby compressing a seal in between the splined ring and a lower shoulder in the combined tool. In placing the drilling riser in tension, the lower clutch nut becomes engaged while the upper clutch nut becomes disengaged.

To release the combined tool from the casing hanger, the drilling riser is rotated clockwise in the tensed position thereby rotating the lower clutch nut rather than the upper clutch nut as before. This causes the upper clutch nut to rise and removes the support for the expanded snap ring latch such that it contracts from the recess and frees the combined tool from the casing hanger.

The production riser is then tied back with the casing hanger using the same combined tool attached to the lower end of production riser. Upon righthand rotation of the riser, the latch is expanded, and upon placing the riser in tension, the pack-off assembly is engaged. Then to release, the production riser is rotated clockwise thereby removing the support for the expanded latch ring and freeing the combined tool from the casing hanger.

Embodiment III offers the advantage of only one tool for both the installation and tying back of the casing hanger, but it requires maintaining the handling string in tension to activate the pack-off assembly. Embodiment II and embodiment III have a common advantage over embodiment I in that the production riser and tie-back extension tool can be removed without rotating the riser pipe in a counterclockwise direction which would cause the couplings between the sections of pipe to loosen.

Other objects and advantages of the invention will appear from the following description.

BRIEF DESCRIPTION OF THE DRAWINGS

For a detailed description of the preferred embodiments of the invention, reference will now be made to the accompanying drawings wherein:

FIG. 5 is a cross-section of the tie back extension tool and production riser of embodiment I stabbed within the casing hanger;

FIG. 6 is a cross-section of the tie back extension tool of embodiment I engaged with the casing hanger;

DESCRIPTION OF THE PREFERRED EMBODIMENTS

The present invention includes three preferred embodiments of a method and apparatus for installing a casing hanger supporting a string of casing, for removal of the installation equipment, and for tying back to the casing hanger with production riser casing extending to the surface. Although the present invention may be used to install and tie back a casing hanger to be supported anywhere in the well, generally the present invention is used where the hanger is to be supported in an inaccessible location such as underwater or underground. The first preferred embodiment discloses the use of two threaded connections, one to disconnect the handling string used to install the hanger and one to tie back production riser to the hanger after the handling string is removed; the second preferred embodiment has a threaded connection and a latch connection; and the third preferred embodiment utilizes a single latch connection. All of these connections are unique in that they all are activated by a rotation of the handling string in a direction which causes the threaded connection between the pipe sections in the handling string to tighten rather than disengage. For clarity the direction of rotation of the handling string is determined by an observer standing on the drilling deck looking downward on the upper end of the handling string. Although the present invention may be used to install and tie back either pipe, tubing or casing, the three embodiments will be described in terms of casing.

Figure 1:
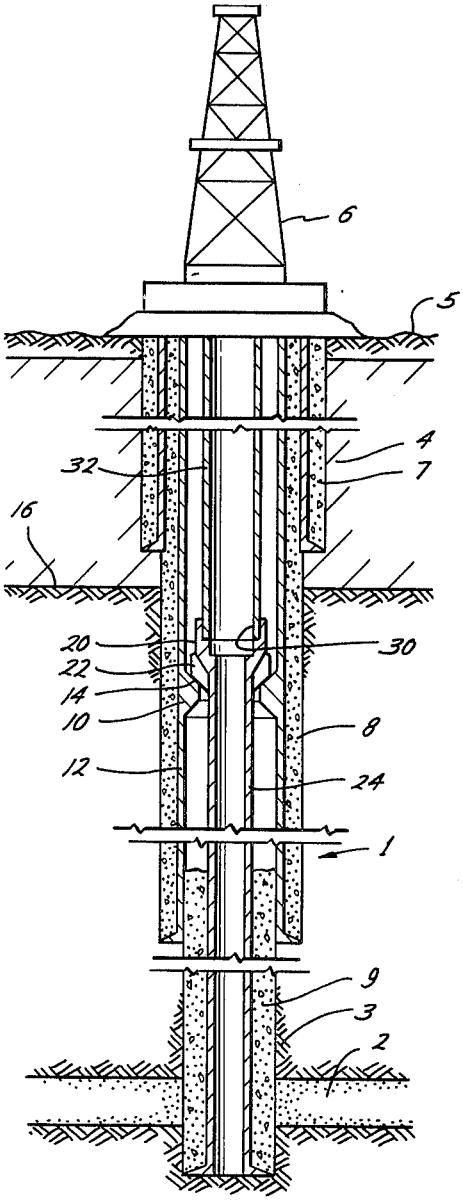
FIG. 1 is a general cross-section of the complete well with the drilling riser installed.
Figure 2:
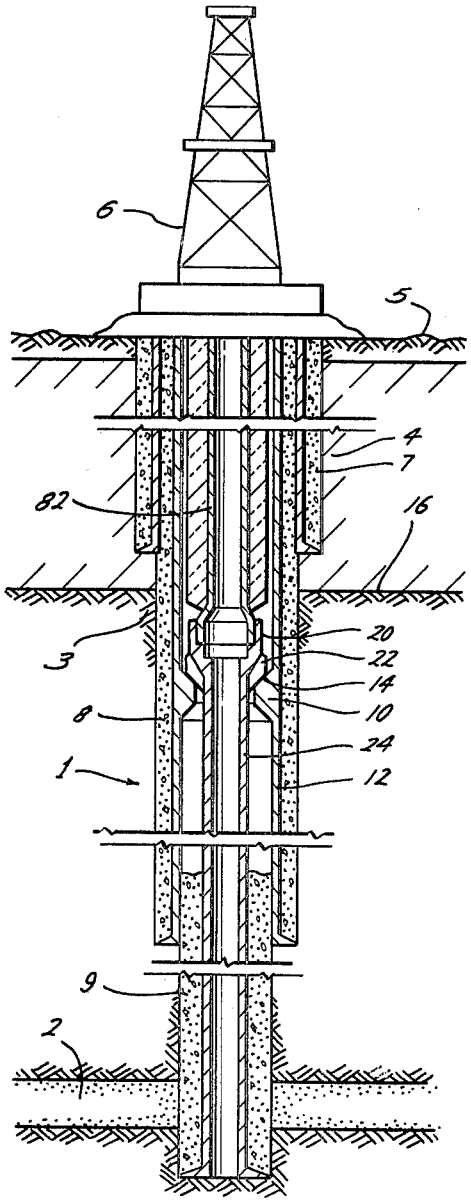
FIG. 2 is a second general cross-section of the complete well with the insulated production riser tied back into the casing hanger.

The environment for the different preferred embodiments is common and is illustrated in FIGS. 1 and 2. FIG. 1 illustrates the well at the drilling stage with the casing hanger installed and the drilling riser extending to the rig. FIG. 2 shows the well at the production stage with the drilling riser casing having been replaced with production riser casing. The apparatus of embodiment I is featured in these two figures although either embodiment II or III could have been used.

Referring now to FIGS. 1 and 2 there is shown a well casing 24 extending from the hoped for producing formation 2 up through the solid earth 3 and permafrost 4 to the surface 5. A drill rig 6 surmounts the well. A series of concentric strings of casing 11, 12, 24 of successively smaller diameter extend down the well bore to progressively greater depths. Each string of casing is cemented in the well bore from the lower end of the string to a level thereabove as shown at 7, 8, 9. The innermost string of casing 24 is suspended on a casing head 10 which was affixed to the previously installed casing string 12. The casing head 10 has an annular internal restrictive shoulder 14 for engagement with ribs 22 radially extending from the external surface of hanger 20. The ribs 22 and shoulder 14 have mating beveled edges which engage as the hanger 20 is lowered through the casing string 12. The casing head 10, therefore, dictates the location of the casing hanger 20 in the well and provides for the support of the hanger 20 and casing string 24. In a permafrost region the casing head 10 will be located just below the permafrost line 16 several hundred feet below ground level.

In setting the innermost string of casing 24, the assembly lowered into the well includes a running tool 30, a handling string (drilling riser casing) 32, casing hanger 20, and casing string 24. The casing hanger 20 suspends casing string 24, and running tool 30 couples drilling riser 32 to casing hanger 20.

FIRST EMBODIMENT

Figure 3:
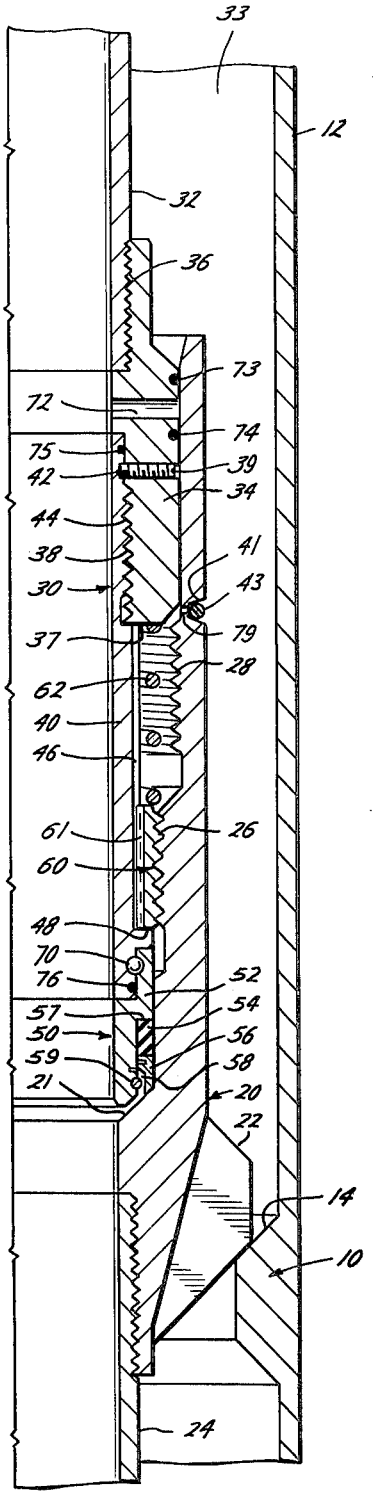
FIG. 3 is a cross-section of the running tool and drilling riser of embodiment I installed within the well.

In embodiment I, as shown in FIG. 3, the running tool 30 comprises an outer tubular mandrel 34, an inner tubular mandrel 40, a pack-off assembly 50, and an internally splined externally threaded nut 60. The outer mandrel 34 has an internally threaded box 36 at its upper end for connection with drilling riser 32 and an internally threaded box 38 at its lower end for connection with inner mandrel 40. A set screw 39 is threaded through outer mandrel 34 and into a recess 42 in inner mandrel 40 to prevent any disconnection of the threaded connection at 44. Outer mandrel 34 has been made separate from inner mandrel 40 to allow outer mandrel 34 to be replaced with a mandrel having a different diameter box 36 thereby permitting the use of different sized drilling riser casing 32 as the handling string.

The outer surface of inner mandrel 40 is splined at 46 to cooperate with the internally splined surface 61 of nut 60. Nut 60 is permitted axial movement on the splined connection relative to inner mandrel 40 but is limited by shoulder 48 at the lower position and by shoulder 37, created by the lower portion of outer mandrel 34, at the upper position. Splined nut 60 is biased downwardly by compression spring 62 forcing nut 60 into engagement with the lower internal threads 26 of casing hanger 20 upon connection with hanger 20.

The pack-off assembly 50 includes an upper retainer ring 52, a seal 54, and a lower retainer ring 56. The seal 54 is a ring inserted into an annular recess created by shoulder 57 of upper retainer ring 52 and the upper edge of lower retainer ring 56. Lower retainer ring 56 is permitted to reciprocate on the lower end of upper retainer ring 52 by means of an annular slot 58. A snap ring 59 slips in an annular groove in the lower external surface of upper retainer ring 52. The snap ring 59 works within slot 58 and keeps the lower retainer ring 56 from slipping off the lower portion of upper retainer ring 52 by abutting upper shoulder 55 in slot 58 shown in FIG. 4.

The lower end of inner mandrel 40 telescopes into the upper retainer ring 52 of pack-off assembly 50, and is held in place by thrust bearings 70 which rotate in corresponding races in the outer surface of inner mandrel 40 and in the inner surface of upper retainer ring 52. Once the pack-off assembly 50 is in sealing engagement with the casing hanger 20, the rotatable connection permits the pack-off assembly 50 to remain stationary while running tool 30 is being rotated.

Casing hanger 20 has an internal annular restrictive shoulder 21 with a beveled surface which engages lower retainer ring 56 as running tool 30 is telescopingly lowered into the casing hanger 20. Upon the insertion of the running tool 30, and the engagement between lower retainer ring 56 and shoulder 21, the lower retainer ring 56 is forced axially upward compressing seal 54 thereby sealingly engaging casing hanger 20.

When the running tool 30 is initially inserted into the casing hanger 20 prior to lowering the assembly into the well, the pack-off assembly 50 passes readily through the larger diamenter portions of the hanger with the seal engaging socket 53, but the nut 60 abuts the upper end of lower threads 26 in the casing hanger and as inner mandrel 40 moves downwardly relative to the nut the spring 62 is compressed. To complete the connection between the tool 30 and hanger 20, the running tool 30 is rotated counterclockwise (lefthand rotation), as seen by an observer looking down into the well, causing splined nut 60 to engage lefthand threads 26 as spring 62 forces nut 60 downward. The completed engagement further compresses seal 54 and locks the running tool 30 and casing hanger 20 together.

Port 72 in outer mandrel 34, which will be discussed later, is sealed to hanger 20 by means of O-rings 73 and 74 extending around outer mandrel 34 and located above and below the port 72 and between outer mandrel 34 and casing hanger 20. The connection between outer mandrel 34 and inner mandrel 40 is sealed by O-ring 75, and the connection between the inner mandrel 40 and upper retainer ring 52 is sealed by O-ring 76.

The above described assembly is then lowered down into the well using drilling riser 32 as the handling string. It is significant that the sections of drilling riser 32 are connected by rotating the threads in the clockwise direction (righthand rotation). If the sections of drilling riser 32 were engaged using a counterclockwise rotation, all connections and disconnections of the three embodiments of the connection between the running tool and casing hanger would be effected by rotation opposite in direction to that described to prevent the loosening of the connections between the sections of drilling riser 32. As the assembly is lowered by adding sections of casing to the handling string, it will land into position as shown in FIG. 3.

Upon the completion of the installation of the casing hanger 20, the casing string 24 is cemented into place. If for some reason it becomes necessary to wash out the annulus between drilling riser 32 and casing 12, the running tool 30 can be raised a sufficient distance to open port 72, after rotating the drilling riser clockwise causing nut 60 to move upwardly to the extent required to allow such elevation of the drilling riser. The objective of using port 72 is that this permits the washing of annulus 33 without passing any fluid around the lower end of the running tool 30 which would deteriorate seal 54.

In completing a well through a permafrost region, the handling string 32 is made up of drilling riser casing and cannot be insulated production riser casing which would restrict annulus 33 between handling string 32 and casing 12. Port 72 could not be used if the handling string 32 were insulated riser casing since fluid flow through annulus 33 would be too restricted and the fluid would be destructive to the insulation since the insulation is not compatible with liquids. Fluid flow through annulus 33 is also required in testing the seals and the packers. Therefore, the insulated production riser casing with its larger diameter cannot be used during these completion steps.

The insulated production riser, however, must be used prior to production since drilling riser casing is not insulated. As previously discussed, insulation of the pipe is required to prevent the oil from heating and melting the permafrost surrounding the conductor casing, thereby preventing the ground from subsiding under the drilling rig.

Figure 4:
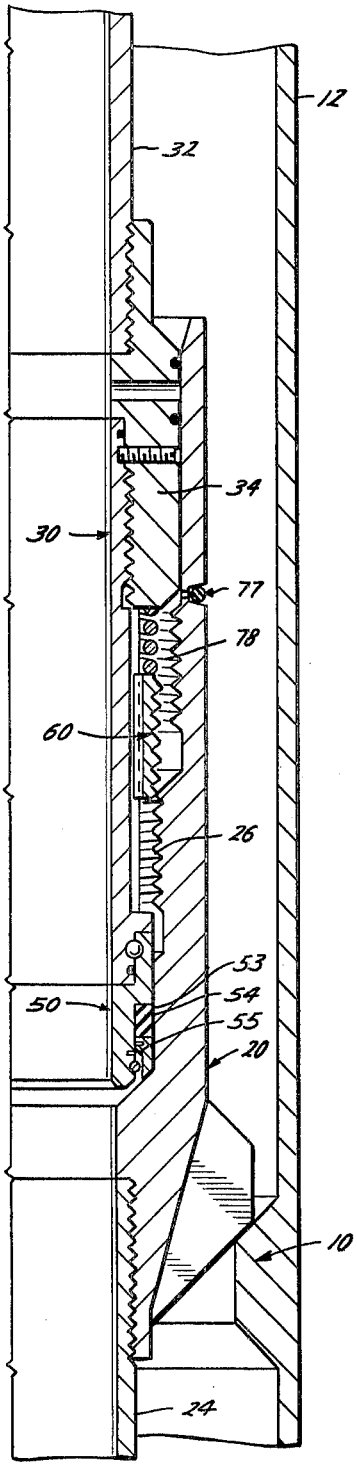
FIG. 4 is a cross-section of the running tool of embodiment I upon disengagement from the casing hanger.

To remove running tool 30 and drilling riser 32 as illustrated in FIG. 4, drilling riser 32 is rotated clockwise (righthand rotation). Since casing hanger 20 is connected to casing string 24 and the latter is cemented in place and cannot rotate, splined nut 60 rises on lefthand threads 26 until running tool 30 completely disconnects from casing hanger 20. O-ring vent valve 77 allows for any volume change of fluid in recess 78 by permitting fluid to escape as splined nut 60 rises. Valve 77 is a one-way valve and does not permit any fluid to enter recess 78. Valve 77 comprises an O-ring 43 lodged in an annular recess 41 in the outer surface of hanger 20 and covers minute holes 79 in hanger 20. An outer fluid pressure forces the O-ring to close the holes, whereas an inner fluid pressure moves the O-ring away from the holes permitting excess fluid to escape.

Pack-off assembly 50 does not rotate with the rotation of running tool 30. This not only prevents wear on seal 54 but provides less drag during the rotation of drilling riser 32 and running tool 30.

The rotation of drilling riser 32 to the right in no way causes the connections between the sections of drilling riser casing to disconnect but forces them to tighten instead. FIG. 4 illustrates running tool 30 in the disengaged position.

After removal of drilling riser 32, it is possible to run a work pipe (not shown) into the hole and pump the well dry of well fluids from the casing hanger 20 to the surface. This permits this portion of the well to be filled with air which is a better insulator than the well fluid for the prevention of heat flow to the permafrost.

To run-in and tie-back to the casing hanger 20 with insulated production riser casing as shown in FIG. 5, a tie-back extension tool 80 is attached to the lower end of production riser 82. Tool 80 is the same as tool 30 except as described hereinafter. Running tool 30 cannot be used since the handling string would have to be rotated in a counterclockwise direction for nut 60 to engage threads 26. This might cause disengagement of the right hand threaded connections of production riser 82. Therefore, hanger 20 is provided with righthand threads 28 in the upper portion of its internal surface, and a splined nut 90 is used in tool 80 with threads opposite to those of nut 60 in running tool 30. This provides an engaging connection actuated by the clockwise rotation (righthand rotation) of riser pipe 82.

Righthand threads 28 are located above lefthand threads 26 and have a larger diameter. This allows the run-in seal assembly 50 and connection nut 60 to pass through thread 28 without contact therewith. Since righthand threads 28 are reserved only for connection with the tie-back extension tool 80, a good tie-back connection is assured. Since righthand threads 28 have a larger diameter, the inner mandrel 86 and splined nut 90 have a correspondingly larger diameter than their counterparts used in running tool 30.

It should be noted that if the sections of riser pipe 82 were connected by a counterclockwise rotation rather than the generally used clockwise rotation as described with drilling pipe 32, running tool 30 could be used for tying back of production riser 82 since a connection by counterclockwise rotation would be required.

The other differences between running tool 30 and tie-back extension tool 80 are that outer mandrel 84 has no port, since there is no need to pass fluids through the annulus 33, and that the pack-off assembly 87 has no compressed seal. However, it can be readily seen that pack-off assembly 50 in running tool 30 and pack-off assembly 87 in tie-back extension tool 87 are interchangeable depending upon the design criteria required. The pack-off assembly 87 is rotatably mounted on the lower end of inner mandrel 86 by means of thrust bearings 91. Two O-rings 88, 89 are disposed in grooves in the peripheral surface of pack-off assembly 87 sealingly engaging seal socket 51 of casing hanger 20.

In all other aspects tie-back extension tool 80 is comparable to the structure of running tool 30. O-ring 47 seals between outer mandrel 84 and casing hanger 20 and O-ring 93 seals between inner mandrel 86 and outer mandrel 84. Again a set screw 94 is used to secure the connection between the inner mandrel 86 and outer mandrel 84. A vent valve 95 is again used to release any fluid pressure in chamber 96. O-ring 97 is placed between pack-off assembly 87 and inner mandrel 86 to provide a fluid tight seal.

To attach tie-back extension tool 80 to casing hanger 20, production riser 82 with insulation 83 is lowered into the well and tie-back extension tool 80 is stabbed into casing hanger 20 as shown in FIG. 5. Compression spring 92 forces splined nut 90 into engagement with righthand threads 28. Production riser 82 is then rotated clockwise, and the connection is completed as shown in FIG. 6. Again, the righthand rotation of the riser 82 tightens the connections of the riser 82 and prevents any disengagement.

Upon abandoning the well, the production riser 82 is removed by rotating it counterclockwise which causes splined nut 90 to rise on righthand threads 28. Upon disengagement of the threads, the riser 82 and tie-back extension tool 80 can be removed. Should the riser sections unscrew and become disconnected, leaving the tool 80 in the well, no great harm is done since the well is being abandoned anyway.

In summary, the method of installing and tying back the casing hanger 20 described in embodiment I includes connecting a running tool and handling string to a casing hanger with attached casing string while at the surface, lowering the casing hanger and casing string attached with the handling tool and handling string into the well, continuing the lowering while successively adding at the surface sections of casing to the handling string, landing the casing hanger on the casing head, cementing the casing string, disconnecting the handling tool by rotating the handling string clockwise, removing the handling tool and handling string, connecting a tie-back extension tool to a string of insulated casing while at the surface, lowering the string of insulated riser casing with tie-back extension tool attached, continuing the lowering while successively adding at the surface sections of casing to the riser string, stabbing the tie-back extension tool into the casing hanger, and connecting the tie-back extension tool by rotating the insulated riser clockwise.

SECOND EMBODIMENT

In the first preferred embodiment of the invention, shown in FIGS. 3–6, the handling tool 30 was disconnected from the casing hanger 20 by the disengagement of a threaded connection through the clockwise rotation of the handling string 32, and the tie-back extension tool 80 was tied back to the casing hanger 20 by the engagement of a threaded connection again through the clockwise rotation of the production riser 82. Referring now to FIGS. 7–12, in the second preferred embodiment a threaded connection is again used to disconnect the handling tool 100 and casing hanger 120 upon clockwise rotation of the handling string 112, but the tie-back extension tool 150 is tied back to the casing hanger 120 using a latching mechanism actuated by the clockwise rotation of the production riser 152.

Figure 7:
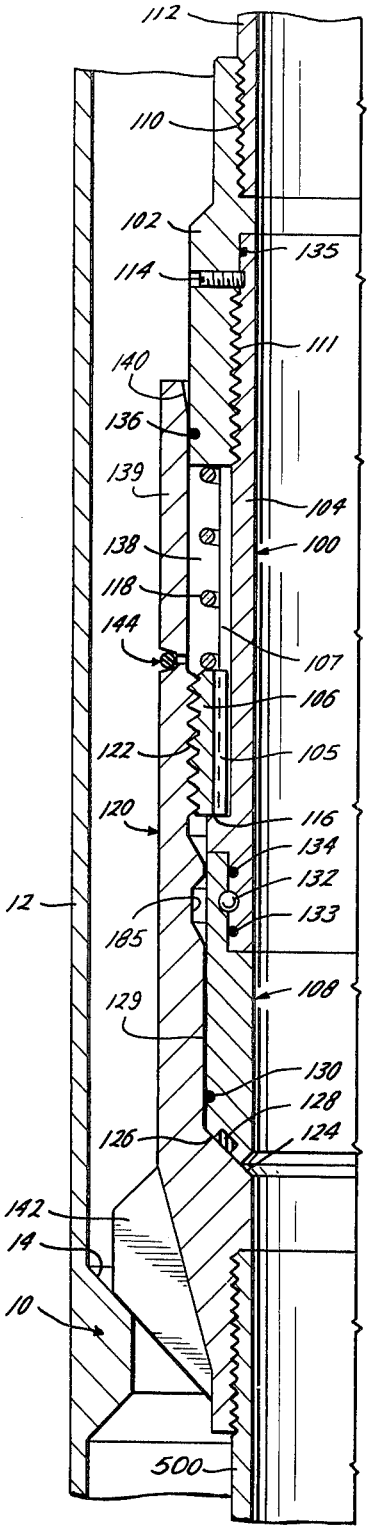
FIG. 7 is a cross-section of the running tool and drilling riser of embodiment II installed within the well.

As illustrated in FIG. 7, the running tool 100 of embodiment II, has a structure comparable to running tool 30 described in embodiment I in that tool 100 includes an outer tubular mandrel 102, an inner tubular mandrel 104, a lefthand threaded, splined nut 106, and a pack-off assembly 108. Outer mandrel 102 has an upper threaded box 110 for connection with handling string 112 and a lower threaded box 111 for connection with inner mandrel 104 thus permitting the interchange of outer mandrels to fit the size of drilling casing used as the handling string 112. A set screw 114 is used to secure the connection between the outer mandrel 102 and inner mandrel 104 but outer mandrel 102 has no port as shown in embodiment I. However, it can easily be seen that a washout port similar to that shown in embodiment I could be added in embodiment II.

The nut 106 is axially slideably mounted on the outer surface of inner mandrel 104. Internal splines 105 on the nut cooperate with external splines 107 on mandrel 104 permitting axial movement limited only by outer mandrel 102 and shoulder 116. Compression spring 118 bearing at its upper end against mandrel 102 and at its lower end against nut 106 biases the nut 106 downwardly to assure its engagement with lefthand threads 122 of casing hanger 120.

Pack-off assembly 108 includes a beveled nose 126 which engages annular internal restrictive shoulder 124 of casing hanger 120. Nose 126 has a recess in which a ring-like seal 128 is inserted for sealing engagement with casing hanger 120. An O-ring 130 is also provided in a groove on the peripheral surface of pack-off assembly 108 to make a fluid tight engagement with the cylindrical portion 129 of the seal engaging socket 131 of casing hanger 120 prior to engagement of nose seal 128 with the shoulder 124 forming the bottom of socket 131. As in embodiment I the pack-off assembly 108 is attached to inner mandrel 104 by means of a thrust bearing 132. Pack-off assemblies 50 and 87 shown in embodiment I could be used in place of pack-off assembly 108 in embodiment II and pack-off assembly 108 could be used in place of either pack-off assembly 50 and 87 in embodiment I.

O-ring seals 133 and 134, and seal 135 provide a fluid tight engagement of the inner mandrel — pack-off assembly connection and of the outer mandrel — inner mandrel connection, respectively. O-ring seal 136 is provided to seal between outer mandrel 102 and casing hanger 120 to prevent any drilling fluid from seeping into chamber 138.

Casing hanger 120 is provided with upwardly extending guard sleeve 139 to shield spring 118. Annular chamber 138 is formed between inner mandrel 104 and guard sleeve 139 which is spaced outwardly from the inner mandrel a sufficient distance to receive nut 106 which is elevated above thread 122. Chamber 138 thus provides a spring and nut receiving space.

The handling tool 100 is attached to the casing hanger 120 by stabbing the tool 100 into hanger 120 through the guide bevel 140 at its upper end and rotating the tool 100 counterclockwise (lefthand rotation) to thread the nut 106 onto the lefthand threads 122 as spring 118 forces nut 106 downwardly. The assembly is then lowered with handling string 112, which is lengthened a joint at a time, through the previously installed casing 12 until ribs 142, radially extending from casing hanger 120, engage shoulder 14 on casing head 10 as shown in FIG. 7. The casing string 500 suspended from casing hanger 120 is then cemented.

As in removing running tool 30 in embodiment I, running tool 100 is removed by rotating drilling riser 112 clockwise, which tightens the drilling riser connections, thereby causing splined nut 106 to rise on lefthand threads 122 until complete disengagement occurs. Again, note that pack-off assembly 108 remains stationary since the inner mandrel rotates on thrust bearing 132, and that no vertical movement of running tool 100 is made until the complete assembly is free to be lifted from the well. Vent valve 144, comprising O-ring 145 and one or more ports 146 in the casing hanger guard sleeve 139, is provided to permit the escape of fluid from the contraction of chamber 138 due to the restriction caused by nut 102.

Figure 8:
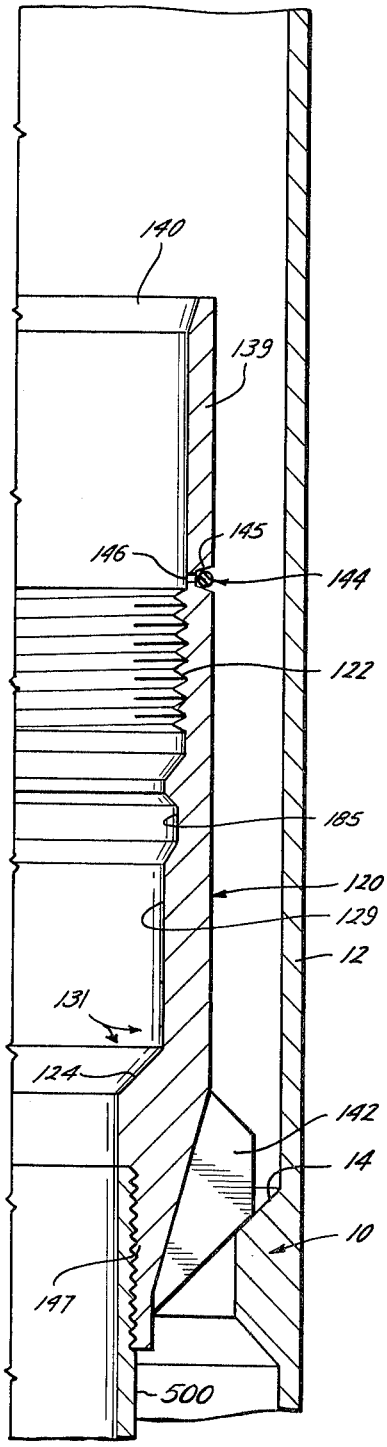
FIG. 8 is a cross-section of the casing hanger of embodiment II installed within the well after the running tool and drilling riser have been removed.

FIG. 8 illustrates the casing hanger 120 after the removal of running tool 100. Note that the casing hanger is tubular and includes righthand thread means 147 for engaging the threaded upper end of casing string 500, support means in the form of ribs 142 for supporting the hanger in a well head (casing head 10), external fluid passage means comprising the channels formed between ribs 142, smooth seal engaging socket 131 including cylindrical portion 129 and shoulder 124, tool connection means in the form of thread 122, vent valve 144, and guard sleeve 139. As distinct from the casing hanger of embodiment I, the tool connection means also includes a latch receiving recess 185 described hereinafter.

Figure 9:
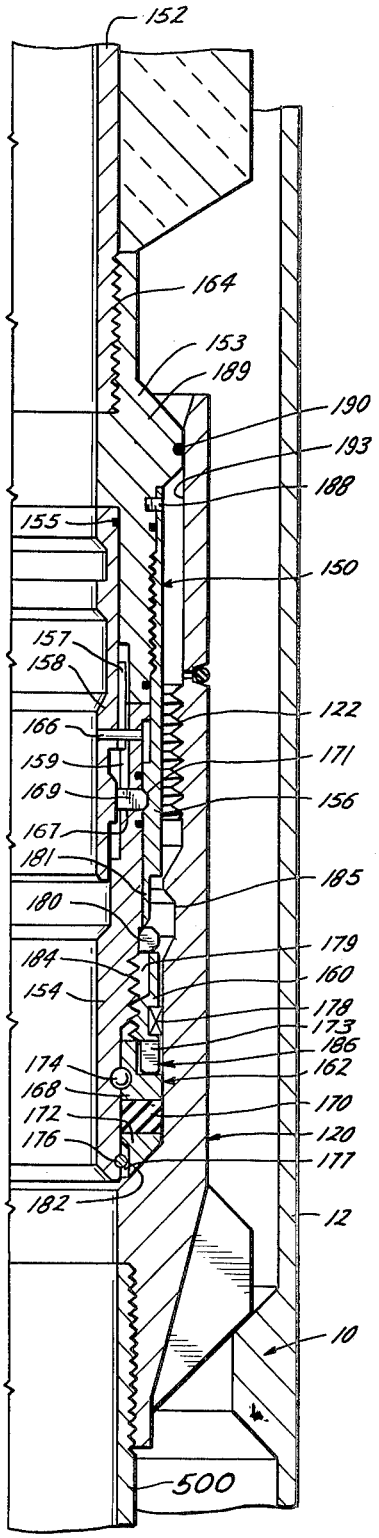
FIG. 9 is a cross-section of the tie back extension tool and production riser of embodiment II stabbed into the casing hanger.

Referring now to FIG. 9, to tie-back in with insulated production riser casing 152, tie-back extension tool 150 is attached to the riser. Tool 150 has a structure quite different from tie-back extension tool 80 of embodiment I since tool 150 has a latch mechanism rather than a threaded connector.

As shown in FIG. 9 tie-back extension tool 150 includes upper tubular mandrel 153, lower tubular mandrel 154, support sleeve 156, releasing sleeve 158, nut 160, and pack-off assembly 162. Nut 160 is an ordinary internally threaded nut as distinct from the externally threaded splined nut previously described. The upper mandrel 153 has a threaded box 164 at its upper end for connection with riser pipe 152. Mandrel 153 has external threads on the other end (rather than a box as in embodiment I) for connection with the upper end of support sleeve 156 and the connection is secured by set screw 188. Lower mandrel 154 telescopes within support sleeve 156 and would be capable of axial movement within support sleeve 156 if it were not for retractable dogs 169 projecting through windows 167 into annular recess 171 in support sleeve 156. Releasing sleeve 158 is slidably mounted within annular recess 159 in the inner surfaces of upper mandrel 153 and lower mandrel 154. Releasing sleeve 158 is provided with external splines 157 slidably engaging splines 159 on the inner surface of lower mandrel 154 to prevent any rotation of releasing sleeve 158. Shear pin 166 secures releasing sleeve 158 in its uppermost position relative to mandrel 153. O-ring 155 seals the sleeve to the mandrel 153. Sleeve 158 holds dogs 169 in radially extended position latching mandrel 154 to support sleeve 156 whereby there is provided a releasable connection between these members and by this means the lower mandrel is connected to the upper mandrel.

Pack-off assembly 162 includes an upper retainer ring 168, a seal ring 170, and a lower retainer ring 172. Upper retainer ring 168 is rotatably connected to lower mandrel 154 by a thrust bearing 174 and has clutch fingers 175 (see FIG. 10) on its upper portion which create recesses for cooperation with the clutch fingers 173 on the lower portion of nut 160 to create a clutch connection 186. Lower retainer ring 172 is slidably mounted around the lower tip of lower mandrel 154 and is limited in its downward travel by a snap ring 176. Ring 176, disposed in an annular groove in lower mandrel 154, protrudes into recess 177 in retainer ring 172 and permits retainer ring 172 to reciprocate but prevents its removal by abutting the upper shoulder of the recess 177. Seal 170 is sandwiched in between the upper retainer ring 168 and lower retainer ring 172 for sealing engagement with casing hanger 120 and lower mandrel 154 upon compression.

Nut 160 has threads engaging the external threads of lower mandrel 154 and, as previously discussed, has a finger clutch engagement 186 with upper retainer ring 162. To inhibit its rotation nut 160 is provided with an anti-rotation unit comprising an elastomer ring 178 outwardly biasing a drag plug hereinafter illustrated in FIG. 13. Supported by the upper end of nut 160 is an expandable snap ring latch 180. The upper end of nut 160 is provided with an annular recess 179 to receive beveled latch expanding tube 181 forming the lower end of support sleeve 156.

The production riser 152 with tie-back extension tool 150 are lowered through casing 12 until tool 150 stabs into casing hanger 120 as shown in FIG. 9. The lower retainer ring 172 engages internal annular restrictive shoulder 182 of hanger 120, and as the weight of the production riser 152 is released, the seal 170 is compressed into sealing engagement with casing hanger 120 and lower mandrel 154 because the tie-back extension tool 150 moves lower while the lower retainer ring 172 remains stationary.

Figure 10:
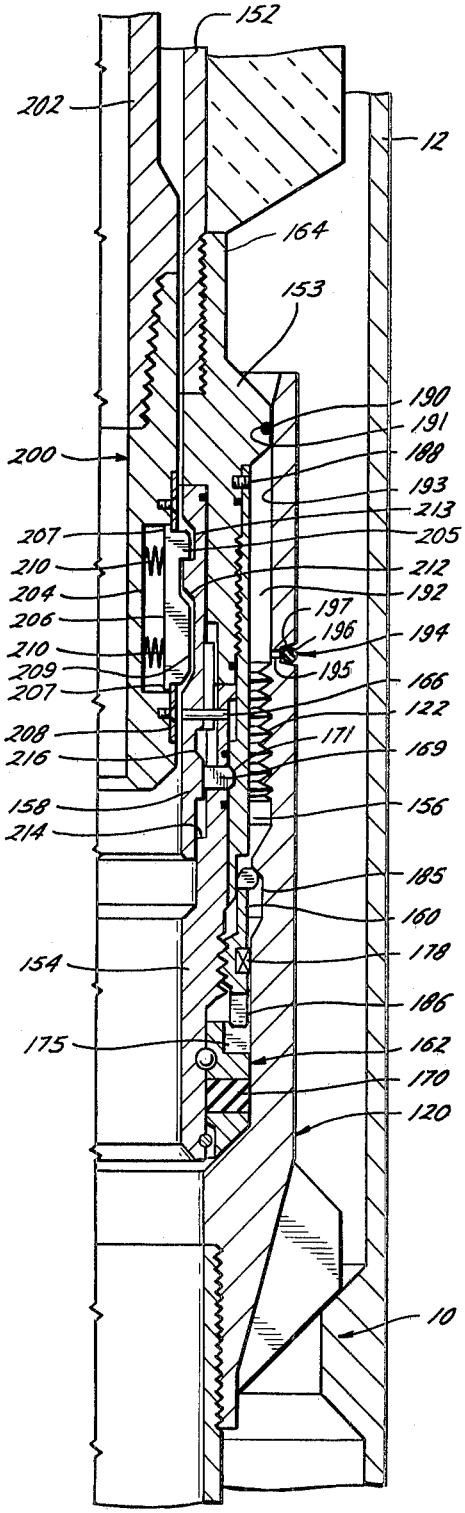
FIG. 10 is a cross-section of the tie back extension tool of embodiment II latched into the casing hanger, and the special tool of embodiment II lowered into position.

To latch extension tool 150 to casing hanger 120 as shown in FIG. 10, the latch mechanism is activated by clockwise (righthand) rotation of the production riser 152 and tie-back extension tool 150. The righthand rotation causes the nut 160 to rise on threads 184. The nut 160 cannot rotate since clutch 186 secures it to the stationary pack-off assembly 162. Latch 180 is a snap ring which is normally in the retracted position against lower mandrel 154. However, as nut 160 rises, it forces latch 180 upward. Latch 180 is beveled on its inner upper edge such that it will cam up tube 181 forming the lower end of support sleeve 156 due to the correspondingly beveled portion on tube 181.

As nut 160 forces latch 180 to cam up onto tube 181 at the lower end of support sleeve 156, latch 180 expands and protrudes into annular recess 185 in the internal surface of casing hanger 120. At its greatest ascent, the nut 160 has moved latch 180 against the upper shoulder of recess 185. The tie-back extension tool 150 is thus secured to casing hanger 120 against axial movement in either direction, the packoff assembly 162 preventing downward movement of the tool and the latch 180 preventing upward movement of the tool relative to the casing hanger.

Latch 180 is now in its expanded position and circumscribes tube 181 at the lower end of support sleeve 156 as shown in FIG 10. Tube 181 forming the lower end of sleeve 156 structurally supports latch 180 in its expanded position. The recess 185 is positioned below threads 122, the casing hanger 120 having a larger inner diameter at threads 122.

Referring now particularly to FIG. 10, upper mandrel 153 is provided with an O-ring seal 190 disposed in an annular groove 191 around a large diameter rib portion 189 of the mandrel. Hub 189 is adapted to telescope within smooth cylindrical socket 193 at the upper end of the casing head 120. Seal 190 seals the mandrel 189 to socket 193, thereby protecting the interior of the casing head and the external mechanisms of the running tool. Seal 190 prevents any fluid from entering or leaving chamber 192 and therefore vent valve 194 is provided for the excess fluid in chamber 192 to escape as nut 160 restricts the volume of chamber 192. Valve 194 includes one or more radial ports 195 in the casing head 120 and an O-ring 196 disposed in annular groove 197 around the outer periphery of the casing head overlying ports 195. Valve 194 is a one-way valve that allows fluid to escape chamber 192 but prevents fluid from entering similar to the vent valve described in embodiment I.

Although no threaded connection is used between tie-back extension tool 150 and casing hanger 120, the latch mechanism is activated into engaged position by clockwise rotation of the riser pipe 152. The use of righthand rotation for such activation prevents loosening any of the connections between the sections of riser pipe 152. The pack-off assembly 162 remained stationary and extension tool 150 made no axial motion thereby preventing any wear on seal 170.

Although the latch mechanism appears more complex than the threaded connection illustrated in embodiment I, embodiment II, as will be discussed later, has the advantage of providing for removal of tie-back extension tool 150 without having to rotate the production riser 152 in the counterclockwise direction. This is especially an advantage if tool 150 and production riser 152 must be removed before well production has been completed.

Figure 11:
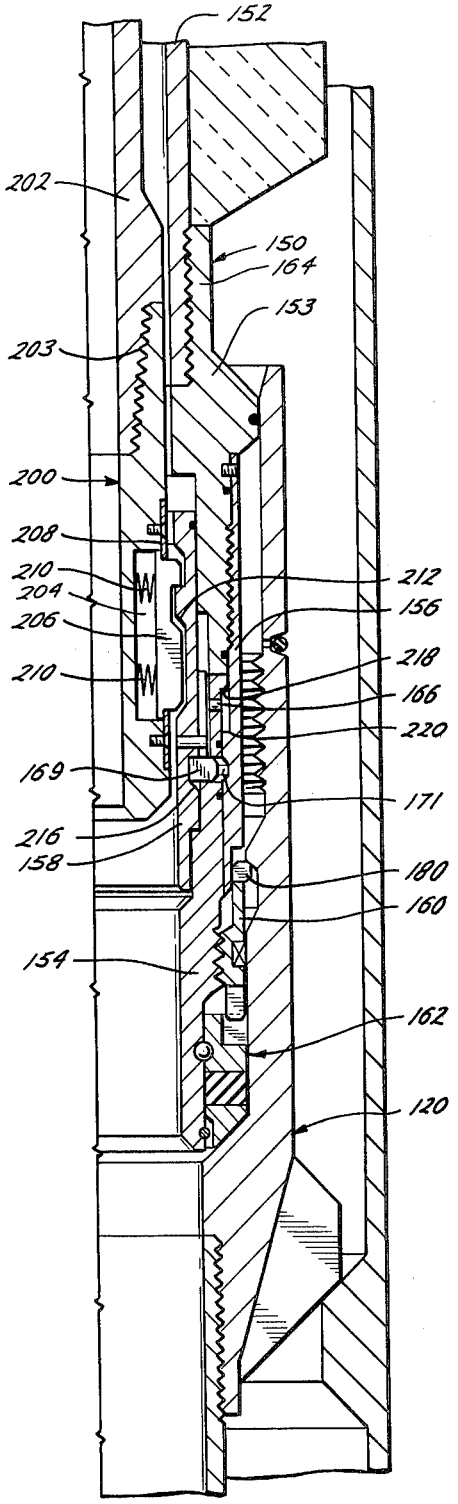
FIG. 11 is a cross-section of the special tool of embodiment II after it has sheared a pin permitting a releasing sleeve to move to its lowermost position as shown.

Referring now to FIGS. 10 and 11, to remove tool 150 and production riser 152, a special releasing tool 200 is lowered into production riser 152 on a handling string 202. Special releasing tool 200 has a threaded box 203 on the upper end for connection with handling string 202. Circumferentially spaced apart around the outer peripheral surface of tool 200 are a series of recesses 204 within which dogs 206 are permitted to reciprocate. The dogs 206 have ears 207 around their edges. Over each recess 204 is positioned a plate 208 which is screwed to tool 200 and which restricts the openings of recess 204 such that the ears hit the restrictive shoulders created by the plate 208 thereby preventing the dogs 206 from dropping out of recesses 204. Springs 210 bias dogs 206 outwardly causing them to protrude into any matching recesses as the tool 200 passes down the well.

Dogs 206 are each provided with upper and lower annular projections 205, 209. As tool 200 passes through the releasing sleeve 158 of tie-back extension tool 150, the projections 205, 209, of spring loaded dogs 206 will latch into matching recesses 212, 213 of releasing sleeve 158. The use of the matching projections and recesses prevents the dogs from engaging with any other recesses as the tool 200 is lowered into position.

The connection of the tool 200 to sleeve 158 permits the transmission of a downward force on handling string 202 to releasing sleeve 158 which will cause shear pin 166 to sever. In the same motion, the releasing sleeve 158 becomes free and moves axially downward until it hits shoulder 214 of lower mandrel 154 shown in FIG. 11. This positions annular recess 216 level with dogs 169. Special handling tool 200 and handling string 202 can now be removed by merely raising handling string 202. The upper beveled edges of dogs 169 are cammed inwardly into annular recess 216 by the upper beveled edges of annular recess 171, thereby freeing the tool 150 from casing head 120. The upper portions of dogs 206 are cammed with the upper surfaces of recesses 212, 213 to retract upon an upward movement.

Figure 12:
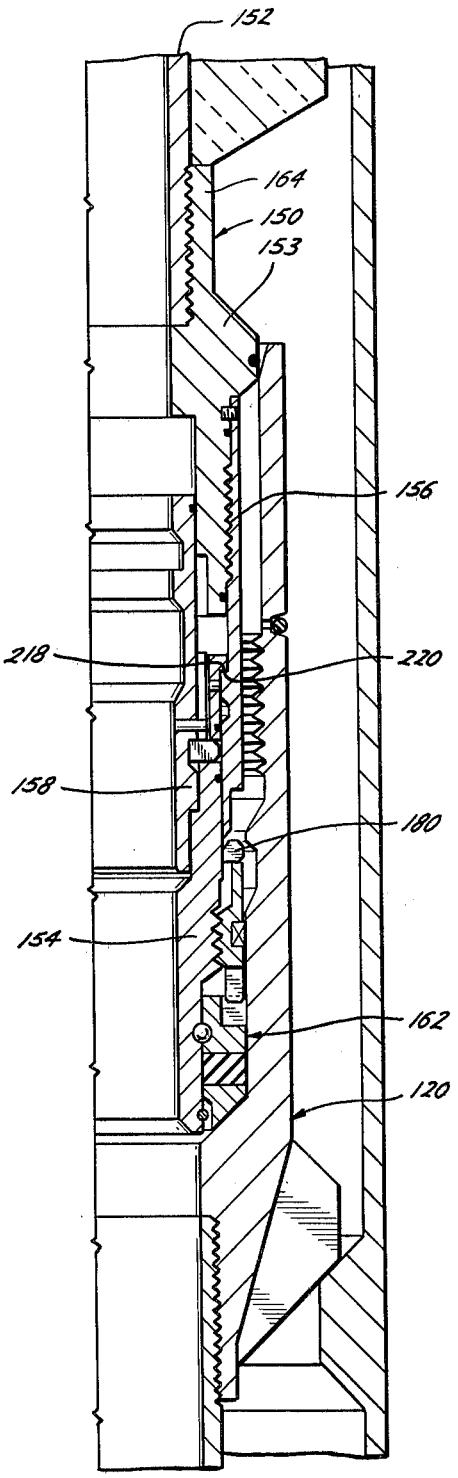
FIG. 12 is a cross-section of embodiment II after the special tool has been removed and the production riser has been lifted to disengage the tie back extension tool from the casing hanger.

After dogs 169 have retracted, support sleeve 156 is permitted a limited axial movement with respect to lower mandrel 154. By lifting on production riser 152 this axial movement is used to slide the tube 181 forming the lower end of support sleeve 156 out from beneath latch 180 which is prevented from moving upward by the shoulder of the recess in the casing hanger 120. Once the tube 181 is removed, latch 180 retracts thereby releasing the connection between the tie-back extension tool 150 and casing hanger 120. This position is illustrated in FIG. 12.

The tie-back extension tool 150 and production riser 152 can then be completely removed. As the extension tool 150 is lifted farther, shoulder 220 on support sleeve 156 engages shoulder 218 on lower mandrel 154, thereby lifting the the whole tool 150 from the well.

The method of installing and tying back casing hanger 120 is the same as that used for embodiment I. However, the further step of lowering a special releasing tool for engagement with the tie-back extension tool to release the connection by an upward force on the riser pipe, can be added to the method in the case of embodiment II.

The casing hanger 120, is a tubular member similar to casing hanger 20 of the first embodiment, but in place of the lower threaded socket 26 of the first embodiment, casing hanger 120 employs latching recess 185.

THIRD EMBODIMENT

Referring now to FIGS. 13–20 there is shown a third embodiment of the invention. As in the previous embodiment the well shown in FIG. 13–20 includes casing head 10 forming part of casing string 12 and provided with an annular internal shoulder 14. Casing hanger 300 is provided with a plurality of circumferentially spread apart ribs 302 by means of which it is supported on shoulder 14. Casing hanger 300 is an annular body provided with internal threads at its lower end by means of which it supports casing string 308.

The third embodiment, unlike embodiments I and II, has no threaded connections between the casing hanger 300 and combined running tool — tie-back extension tool 310. A latch mechanism is used in combination with two clutched nuts each comparable to nut 160 of embodiment II. Embodiment III has the advantage of only requiring one tool 310 to install and tie back the casing hanger 300 whereas the other embodiments require at least two. However, as in embodiments I and II, embodiment III both disconnects the drilling riser and ties back the production riser by clockwise rotation of the riser.

Figure 14:
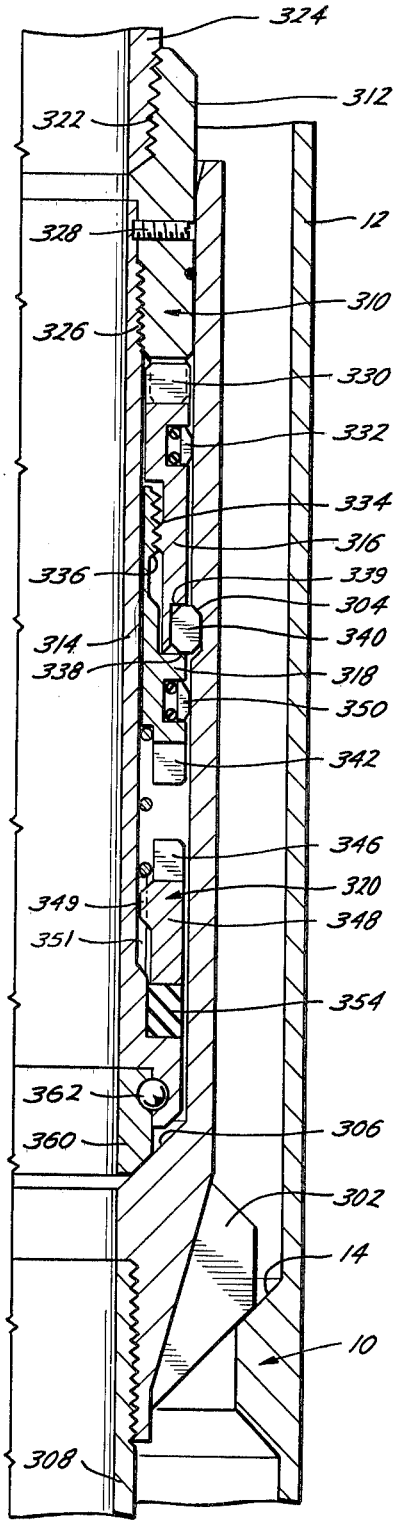
FIG. 14 is a cross-section of the combined tool and drilling riser of embodiment III inserted into and connected to the casing hanger.

Combined tool 310 includes a short tubular mandrel 312, a long tubular mandrel 314, an internally threaded latching nut 316, an externally threaded releasing nut 318, and a pack-off assembly 320. Short mandrel 312 has an upper threaded box 322 for connection with drilling riser 324 as shown in FIG. 14 and a lower threaded box 326 for connection with long mandrel 314. Set screw 328 screws through short mandrel 312 and into a shallow annular recess in long mandrel 314 to secure the connection.

Latching nut 316 circumscribes the external surface of long mandrel 314 and is permitted axial movement. The upper portion of latching nut 316 and the lower portion of short mandrel 312 form clutch type connection 330 by means of mating fingers 331, 333 slipping within corresponding recesses. Initially, clutch 330 is engaged requiring latching nut 316 to rotate with any rotation of combined tool 310. Latching nut 316 has an anti-rotation friction device 332 which inhibits the rotation of nut 316, but the drag of device 332 is overcome by rotation of combined tool 310 when clutch 330 is engaged. However, when clutch 330 is later disengaged, anti-rotation friction device 332 will hold latching nut 316 stationary.

Anti-rotation friction device 332 includes a drag plug 335 reciprocably mounted within a recess in latching nut 316. A vertical pin (not shown) affixed within the recess slides in a vertical slot (not shown) in the drag plug 335. An O-ring 337 is biased between the back of the recess and the drag plug 335 urging the drag plug 335 outwardly.

Releasing nut 318 circumscribes long mandrel 314 and is located below latching nut 316. The upper portion of releasing nut 318 has threads 336 mating with threads 334 located on the lower portion of latching nut 316. Releasing nut 318 has a shoulder 338 on its outer surface which carries a snap ring latch 340 for engagement with latch recess 304 in the inner surface of casing hanger 300. Latch 340 has a bevel 341 on its upper end which is adapted to cam onto a corresponding bevel 343 on the tip of latching nut 316. As the connection between threads 334 and 336 is engaged, causing the shoulder 338 of releasing nut 318 to approach the tip of latching nut 316, latch 340 is expanded into recess 304 for engagement with casing hanger 300 due to bevel 343 moving along bevel 341, as shown in FIG. 14, in the fully expanded position latch 340 is held against axial movement relative to the tool 310 by being captured between shoulder 338 on nut 318 and shoulder 339 on nut 316, and prevents relative axial movement of tool 310 and hanger 300.

Pack-off assembly 320 includes compression ring 348 and seal 354. Compression ring 348 is provided with splines 349 on its inner periphery co-operating with splines 351 on the outer surface of the lower end of long mandrel 314 to allow relative axial motion of the ring and mandrel while preventing relative rotation thereof so as to force ring 348 to rotate with the rotation of combined tool 310. Seal 354 is adapted to be compressed between compression ring 348 and shoulder 356 on the lower end of long mandrel 314.

The lower portion of releasing nut 318 has fingers 342 for engagement with corresponding recesses between fingers 346 extending from the upper portion of compression ring 348 thereby forming a clutch. Releasing nut 318 has an antirotation friction device 350 similar to anti-rotation device 332 to hold nut 318 stationary while latching nut 316 rotates, compression spring 352 bearing at its upper and against shoulder 353 on nut 318 and against shoulder 355 at the upper ends of splines 351 on long mandrel 314 biases releasing nut 318 upward against latching nut 316 to insure engagement of threads 334 and 336. During the disengagement of combined tool 310 and casing hanger 300, the clutch connection between fingers 342 and 346 will be engaged forcing releasing nut 318 to rotate with the rotation of combined tool 310 due to the splined connection between long mandrel 314 and compression ring 348.

Long mandrel 314 has a nose portion 360 which is attached to the lower end of mandrel 314 by thrust bearing 362 including bearings 362, captured in annular grooves 364, 365. This eliminates any frictional drag between the combined tool 310 and the internal annular restrictive shoulder 306 of casing hanger 310 since the nose will remain stationary while the long mandrel 314 will rotate on thrust bearings 362.

Figure 13:
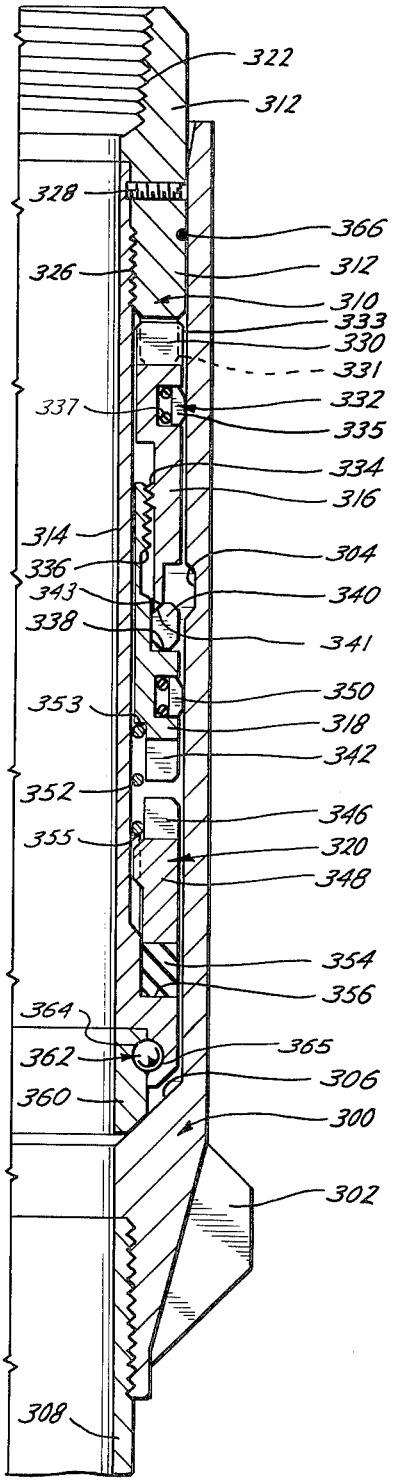
FIG. 13 is a cross-section of a combined running tool and tie back extension tool of embodiment III.

FIG. 13 illustrates the initial insertion of combined tool 310 into casing hanger 300 prior to attachment to the casing hanger. Seal 366 seals between combined tool 310 and casing hanger 300 prior to the time pack-off assembly 320 is set.

To secure the combined tool 310 to casing hanger 300, the tool 310 is rotated clockwise (righthand rotation). Because of clutch connection 330, latching nut 316 rotates causing releasing nut 318 to rise on the righthand threads on latching nut 316. As described earlier, the shoulder 338 of releasing nut 318 forces latch 340 to cam onto the end of latching nut 316 and into recess 304 as latch 340 expands. This secures the tool 310 to the hanger 300. Compression spring 352 forces releasing nut 318 to rise and prevents latching nut 316 from moving downward. Anti-rotation device 350 prohibits releasing nut 318 from rotating such that threads 334 and 336 can thread together. Note that long mandrel 314 rotates on bearing 362 eliminating any frictional contact with shoulder 306 and that seal 354 has not yet sealingly engaged casing hanger 300.

After the tool 310 is attached to hanger 300, lengths of handling string drilling riser casing 324 are successively added and the assembly is lowered through casing 12 until ribs 302 of casing hanger 300 engage annular internal restrictive shoulder 14 of casing head 10, as shown in FIG. 14. Casing 308 is then cemented into place.

Figure 15:
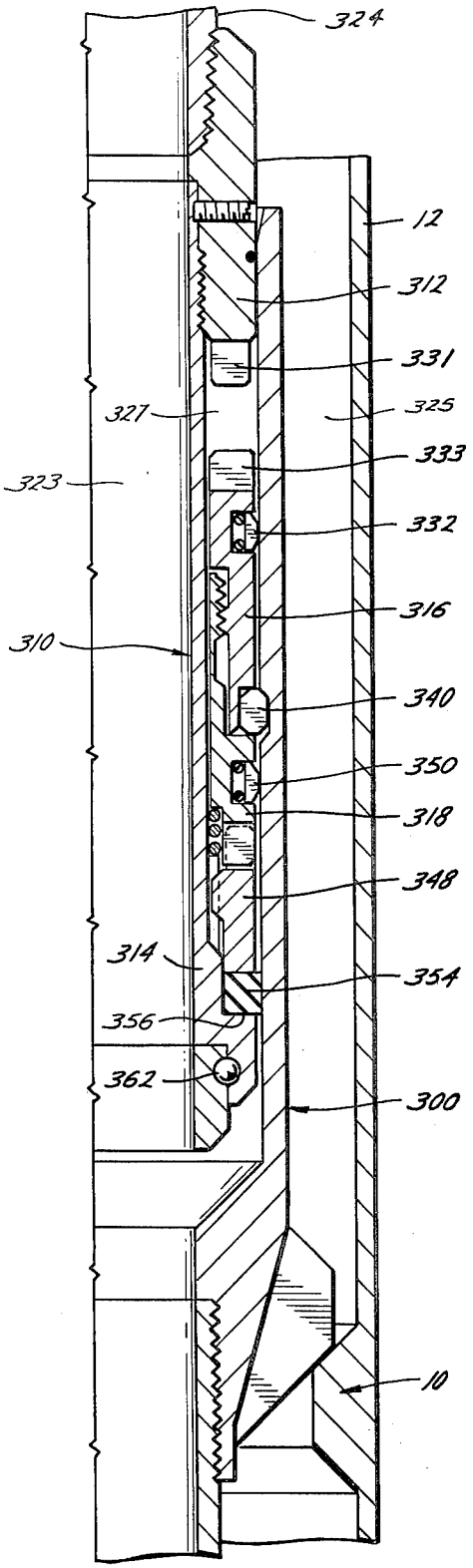
FIG. 15 is a cross-section of embodiment III with the drilling riser in tension and the sealing assembly engaged.

To set pack-off assembly 320 as shown in FIG. 15, the drilling riser 324 is lifted while the tool 310 is latched to hanger 300. This causes the clutch formed by the fingers of compression ring 348 to engage the fingers of releasing nut 318, and it also causes clutch 330 formed by short mandrel 312 and latching nut 316 to disengage. This results in the releasing nut 318 having to rotate with the rotation of combined tool 310 and having latching nut 316 remain stationary due to anti-rotation device 332.

The placing of drilling riser 324 in tension causes seal 354 to become compressed between compression ring 348 and the lower shoulder 356 of long mandrel 314 thereby sealingly engaging between mandrel 314 and casing hanger 310. Slips are placed around the upper end of drill pipe 324 to keep it in tension, and the seal 354 is tested. Seal 354 maintains a pressure differential between the central bore 323 and annulus 325 and also keeps fluid out of chamber 327.

Figure 16:
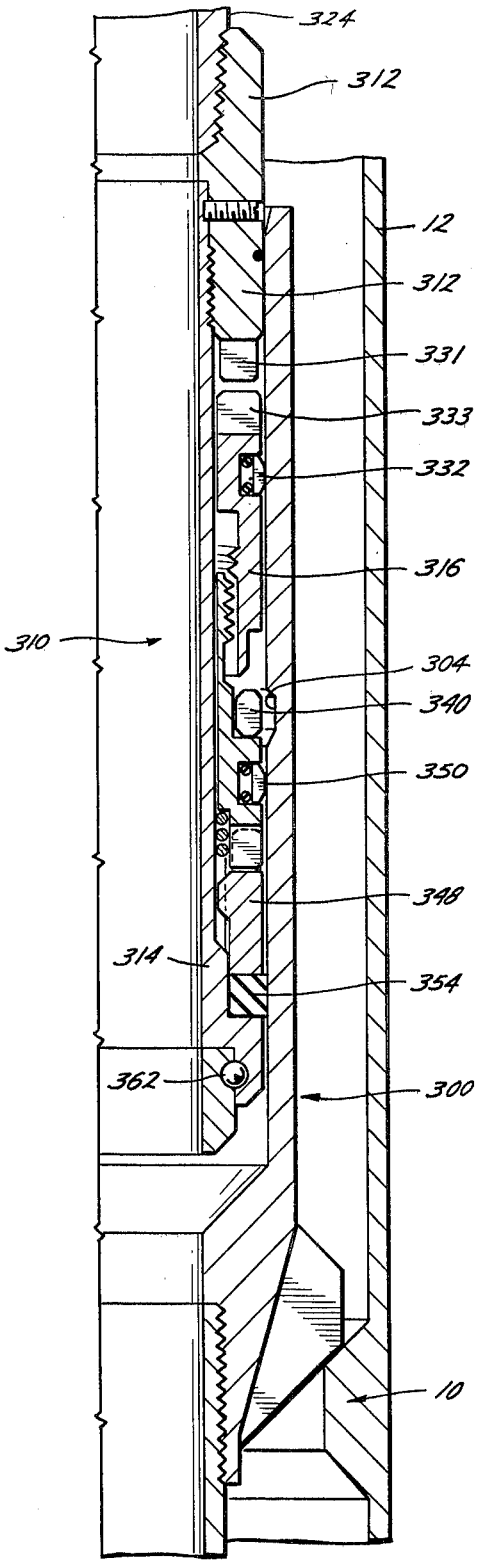
FIG. 16 is a cross-section of the combined tool of embodiment III disengaged from the casing hanger.

As illustrated in FIG. 16 to disconnect combined tool 310 from casing hanger 300, drill pipe 324 is rotated clockwise (righthand rotation) thereby causing releasing nut 318 to rotate while latching nut 316 remains stationary. The righthand rotation of the lefthand threads of the latching nut 316 cause it to rise. As latching nut 316 rises it removes its lower end from underneath snap ring latch 340 causing it to contract and retract from recess 304 thereby disengaging tool 310 from hanger 300. The assembly can then be drawn out of the well as illustrated in FIG. 16.

Figure 17:
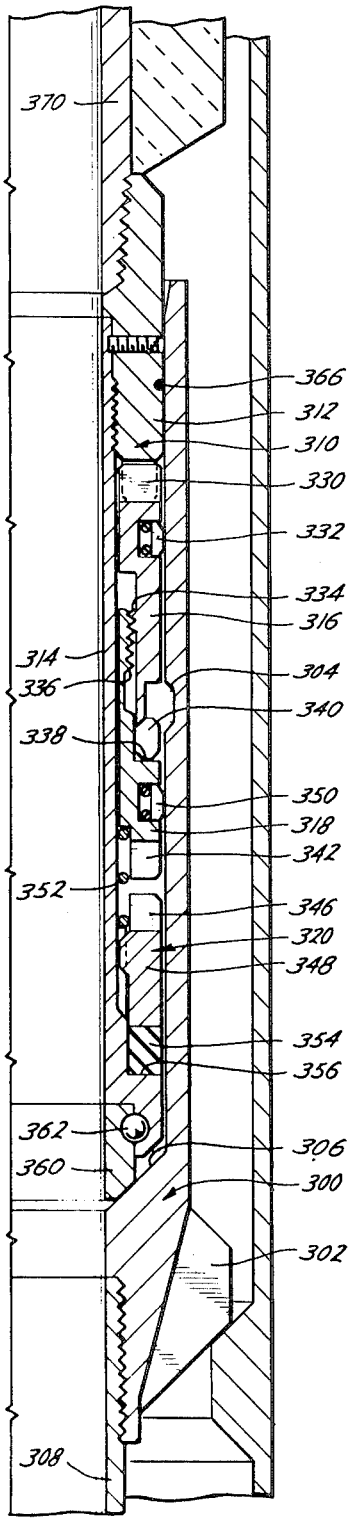
FIG. 17 is a cross-section of the combined tool and insulated production riser of embodiment III landed in the casing hanger.
Figure 18:
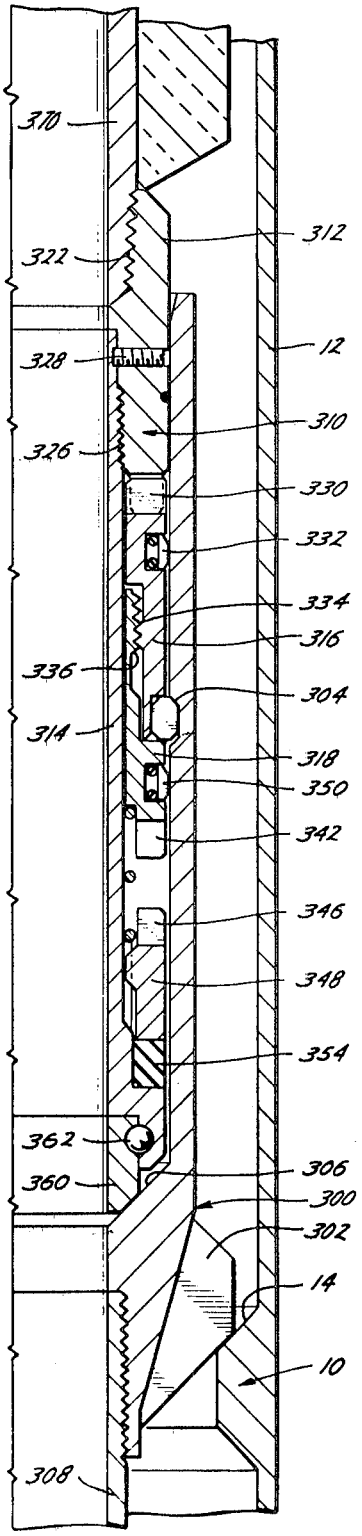
FIG. 18 is a cross-section of the combined tool and production riser of embodiment III connected to the casing hanger.
Figure 19:
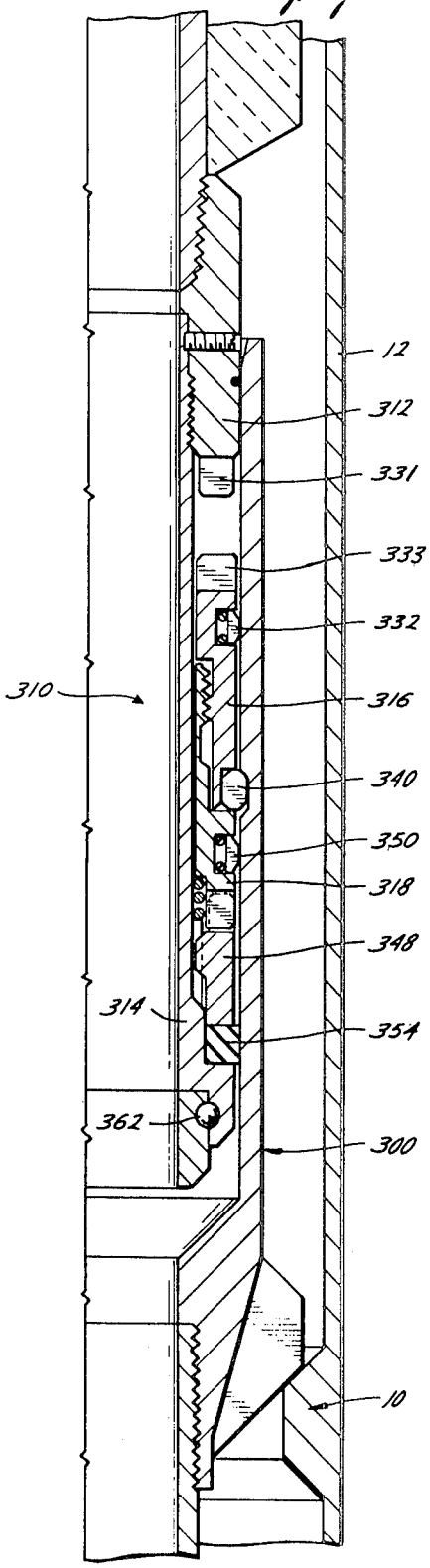
FIG. 19 is a cross-section of embodiment III with the production riser in tension and the sealing assembly engaged.

To tie back with insulated production riser 370, combined tool 310 is attached to the riser 370 and lowered through casing 12. FIG. 17 illustrates embodiment 3 stabbed within casing hanger 300. Upon the clockwise rotation of production riser 370, latch 340 is urged into recess 304 by the upward movement of releasing nut 318 caused by the engagement of threads 334 and 336. This is illustrated in FIG. 18. To activate pack-off assembly 320, production riser 370 is placed in tension thereby engaging the clutch-type connection between compression ring 348 and releasing nut 318 and disengaging clutch 330 between short mandrel 312 and latching nut 316. Slips are placed around production riser 370 to keep it in tension. FIG. 19 illustrates combined tool 310 held in tension with packoff 354 in sealing engagement with the tool 310 and casing hanger 300. This is the condition of the apparatus when the well is being produced.

Figure 20:
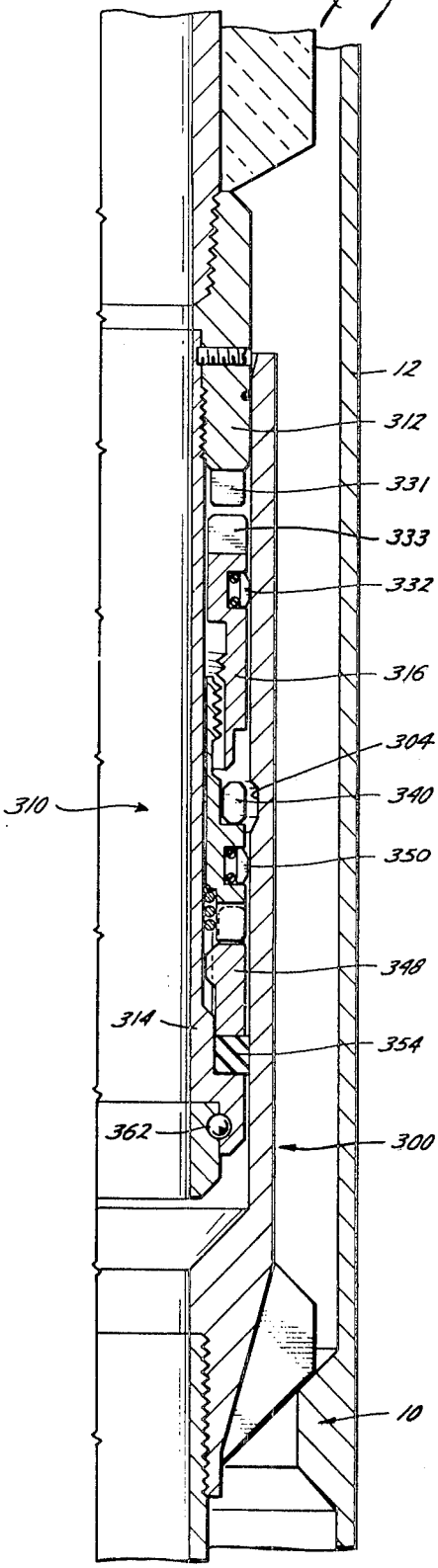
FIG. 20 is a cross-section of the combined tool of embodiment III disengaged from the casing hanger.

Should it be necessary for any reason to remove the production riser 370, the tension in pipe 370 is relaxed to disengage packoff 354. Then riser 370 is rotated clockwise which causes latching nut 316 to rise thereby removing the support behind latch 340 which then retracts, freeing combined tool 310 from casing hanger 300 as shown in FIG. 20.

It is to be noted that the casing hanger 300 of embodiment III is tubular, similar to casing hanger 28 and 120 of the first and second embodiments, but in place of the threaded sockets 26 and 28 of the first embodiment, tool connection means is provided by the single annular recess 304.

Although embodiment III offers the advantage of one tool for both installing and tying back the casing hanger, it requires maintaining the handling string in tension to activate the pack-off assembly 320. Note, however, that embodiment III has in common with embodiment II an advantage over embodiment I in that production riser 370 can be removed without the counterclockwise rotation of production riser 370. This is accomplished more conveniently, however, in embodiment III since a special tool is required in embodiment II to activate the release mechanism.

The method of installing and tying back casing hanger 300 is the same as that used with embodiment I. However, embodiment III also permits the further step of raising the production riser to actuate the seals and rotating the riser to the right to release the latched connection between combined tool and casing hanger.

While a preferred embodiment of the invention has been shown and described, modifications thereof can be made by one skilled in the art without departing from the spirit of the invention.

I claim:

1. A method of completing a well comprising:

lowering a casing hanger suspending a casing string into the well by means of handling pipe until the casing hanger lands on a support affixed within the well;

securing the casing string in the well;

disconnecting the handling pipe from the casing hanger by a rotation of the handling pipe;

removing the handling pipe from the well;

lowering riser casing into the well;

connecting the riser casing to the casing hanger by rotating the riser casing in the same direction as used for disconnecting the handling pipe.

2. A method of completing a well comprising:

attaching drilling casing to a casing hanger suspending a casing string by a first directional rotation of the drilling casing;

lowering the casing hanger into the well by means of the drilling casing;

landing the casing hanger on a casing head;

securing the casing string in the well;

disconnecting the drilling casing by a second directional rotation of the drilling casing;

removing the drilling casing;

lowering a riser into the well;

connecting the riser to the casing hanger by said second directional rotation of the riser; and disconnecting the riser by said first directional rotation of the riser.

3. A method of completing a well comprising:

attaching drilling casing to a casing hanger suspending a casing string by a first directional rotation of the drilling casing;

lowering the casing hanger into the well by means of the drilling casing;

landing the casing hanger on a casing head;

securing the casing string in the well;

disconnecting the drilling casing by a second directional rotation of the drilling casing;

removing the drilling casing;

lowering a riser into the well;

connecting the riser to the casing hanger by said second directional rotation of the riser;

lowering an activation tool within the riser to release the riser from the casing hanger;

releasing the riser from the casing hanger; and lifting the riser from the well.

4. A method of completing a well comprising:

attaching drilling casing to a casing hanger suspending a casing string by a directional rotation of the drilling casing;

lowering the casing hanger into the well by means of the drilling casing;

landing the casing hanger on a casing head;

securing the casing string in the well;

disconnecting the drilling casing by the same directional rotation of the drilling casing;

removing the drilling casing;

lowering a riser into the well;

connecting the riser to the casing hanger by the same directional rotation of the riser as the direction of rotation of the drilling casing; and disconnecting the riser by the same directional rotation of the riser.

5. A method of completing a well comprising:

attaching drilling casing to a casing hanger suspending a casing string by a directional rotation of the drilling casing;

lowering the casing hanger into the well by means of the drilling casing;

landing the casing hanger on a casing head;

securing the casing string in the well;

placing the drilling casing in tension;

disconnecting the drilling casing by the same directional rotation of the drilling casing;

removing the drilling casing;

lowering a riser into the well;

connecting the riser to the casing hanger by the same directional rotation of the riser as the direction of rotation of the drilling casing;

placing the riser in tension; and disconnecting the riser by the same directional rotation of the riser.

6. A method of completing a well comprising:

attaching drilling casing to a casing hanger suspending a casing string by a directional rotation of the drilling casing;

lowering the casing hanger into the well by means of the drilling casing;

landing the casing hanger on a casing head;

securing the casing string in the well;

sealing the casing hanger and drilling casing;

disconnecting the drilling casing by the same directional rotation of the drilling casing;

removing the drilling casing;

lowering a riser into the well;

connecting the riser to the casing hanger by the same directional rotation of the riser as the direction of rotation of the drilling casing;

sealing the casing hanger and riser; and disconnecting the riser by the same directional rotation of the riser.

* * * * *